US005769228A

United States Patent [19]

Wroblewski

[11] Patent Number: 5,769,228

[45] Date of Patent: Jun. 23, 1998

[54] DISPLAY PACKAGE

[75] Inventor: Gerald Wroblewski, Half Moon Bay, Calif.

[73] Assignee: Gillette Canada Inc., Kirkland, Canada

[21] Appl. No.: 772,140

[22] Filed: Dec. 20, 1996

[51] Int. Cl.[6] ..... B65D 75/00

[52] U.S. Cl. ..... 206/461; 206/775

[58] Field of Search ..... 206/461, 462, 206/463, 464, 465, 467, 468, 469, 470, 471, 775

[56] References Cited

U.S. PATENT DOCUMENTS

| | | | |
|---|---|---|---|
| 2,978,851 | 4/1961 | Smith | 53/33 |
| 3,034,271 | 5/1962 | Carpenter et al. | 53/184 |
| 3,166,462 | 1/1965 | Schoder | 156/499 |
| 3,218,776 | 11/1965 | Cloud | 53/30 |
| 3,609,940 | 10/1971 | Lemelson | 53/290 |
| 3,768,638 | 10/1973 | Clarke | 206/461 |
| 3,942,640 | 3/1976 | Hellstrom | 206/469 |
| 4,075,818 | 2/1978 | Wright et al. | 53/180 R |
| 4,119,203 | 10/1978 | Kuchenbecker | 206/461 |
| 4,187,768 | 2/1980 | Suzuki | 93/39.1 R |
| 4,199,058 | 4/1980 | Lense et al. | 206/461 X |
| 4,512,474 | 4/1985 | Harding | 206/461 |
| 4,784,268 | 11/1988 | Perchak | 206/461 |
| 4,811,550 | 3/1989 | Hautemont | 53/478 |
| 4,858,759 | 8/1989 | Herrin et al. . | |
| 4,895,255 | 1/1990 | Fisher | 206/497 |
| 4,901,858 | 2/1990 | Anderson | 206/461 |
| 4,915,231 | 4/1990 | Perbert et al. | 206/461 |
| 5,002,187 | 3/1991 | Rysner et al. | 206/461 |
| 5,117,972 | 6/1992 | Herrin et al. | 206/461 |
| 5,122,328 | 6/1992 | Anderson | 264/554 |
| 5,154,293 | 10/1992 | Gould | 206/461 |
| 5,209,354 | 5/1993 | Thornhill et al. | 206/469 |

*Primary Examiner*—Jacob K. Ackun
*Attorney, Agent, or Firm*—Chester Cekala; Aubrey Brine; Donal B. Tobin

[57] ABSTRACT

A blister package is provided for display in a merchandising rack having a plurality of display enclosures of fixed cross-sectional dimension. The blister package provides a product-containing envelope of plastic material forming a cavity capable of displaying large size articles approaching the maximum dimensions of a display enclosure.

15 Claims, 6 Drawing Sheets

DISPLAY PACKAGE

BACKGROUND OF THE INVENTION

The present invention relates to a blister-card-type package and more particularly to a blister package for use in an upright merchandising rack of the type provided for displaying a product.

Blister display packages which are commonly called "blister-pack" packages are known and are employed widely in the merchandising field, generally having a preformed product closure attached to a paperboard or plastic backing. The choice of this type of packaging concept over others known in the art depends greatly upon the ultimate effect which is desired to be presented to the consumer.

However, when blister packages of the type under consideration are deemed desirable, one way in which they are presented to the consumer is to provide a vertical or horizontal support for enclosing and displaying the article contained in the blister package to the consumer.

The typical upright merchandising rack is manufactured by folded panels of paperboard, metal or plastic, and in many instances comprises a plurality of display enclosures of fixed cross-sectional dimension. While the merchandising racks are intended to provide easy access of the consumer to the product being displayed, it is also desirable that the rack be designed to display as many items, such as toothbrushes, windshield wipers, lipsticks, cosmetics, et cetera, as possible in the space allotted by the retail merchandiser for the display.

In many fields, such as toothbrush merchandising, the merchandising racks are provided with openings into the enclosures which are of a fixed cross-section, which has generally been standardized. It is, therefore, obvious with the ongoing design of toothbrush structures having various handle and brush configurations that a problem exists in providing a blister package of the type under consideration which is adaptable to the merchandising racks presently provided.

It is, therefore, an object of the present invention to provide a blister package which is capable of accommodating articles of manufacture which have a dimension, or dimensions, closely approximating the cross-section of those of the blister package, itself.

A further object of the invention is to provide a blister package for employment in upright merchandising racks which will accommodate articles of manufacture closely approximating the dimensions provided in the display enclosure of a merchandising rack.

Still another object of the invention is to provide a blister package achieving the above objectives which is capable of being constructed in a simple manner employing materials of presently known blister packages.

SUMMARY OF THE INVENTION

The above objects and other objectives which will become apparent as the description proceeds are accomplished by providing a blister package for use in an upright merchandising rack which comprises an elongate molded plastic envelope having a pair of opposed side walls, a pair of end walls and an upper wall to form a cavity therebetween. The envelope has an opening opposite the upper wall and a substantially elongate planar member is provided to cover the opening, the planar member having a pair of opposite side edges each disposed adjacent a respective envelope side wall, and a pair of end edges. The pair of opposite side walls are spaced one from the other a distance equal to or greater than the distance between the opposite side edges of the planar member for at least a portion of the length of the elongate plastic envelope.

The blister package may further have a flange means for attachment of each pair of opposed side walls to the elongate planar member, the flange means extending outwardly from the cavity and substantially parallel with the planar member. In one embodiment of the invention the side walls are oriented downwardly and inwardly of the cavity and each has its bottom edge attached to the inner edge of the flange means.

The planar member is generally formed of paperboard material and the upper wall of the described embodiment generally forms an elongate arcuate surface opening into the cavity.

In an alternate embodiment, the blister package may contain a pair of side walls which extend downwardly from the upper wall in substantially parallel relation one with the other. In this embodiment each of the side walls is provided with an elongate portion at its bottom edge, the elongate portion being of arcuate form extending into the cavity and connecting the bottom edge of the respective side wall to the flange means which extends outwardly of the cavity and substantially parallel with the planar member.

BRIEF DESCRIPTION OF THE DRAWING

Reference is made to the accompanying drawing in which there is shown illustrative embodiments of the invention from which its novel features and advantages will be apparent, wherein.

DESCRIPTION OF THE PREFERRED EMBODIMENT

Figure 1:
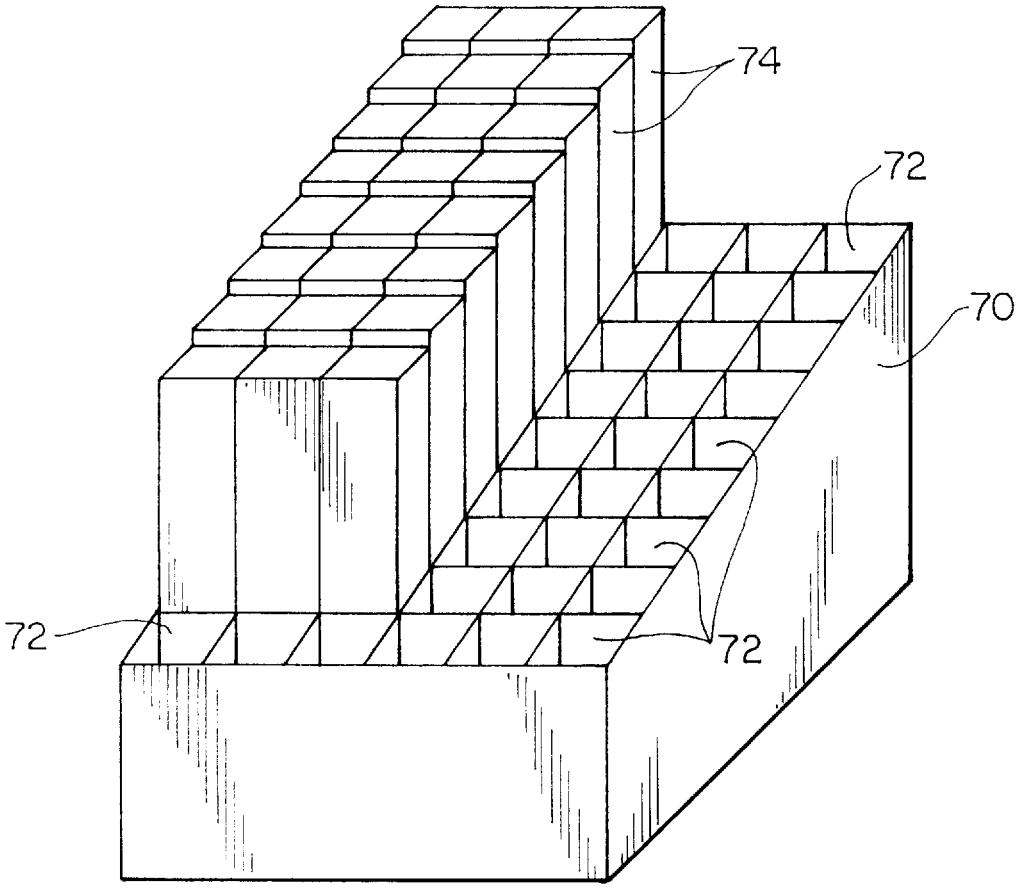
FIG. 1 is an elevational perspective view showing an upright merchandising rack of the type for which a package constructed in accordance with the teachings of the present invention is uniquely adaptable.
Figure 2:
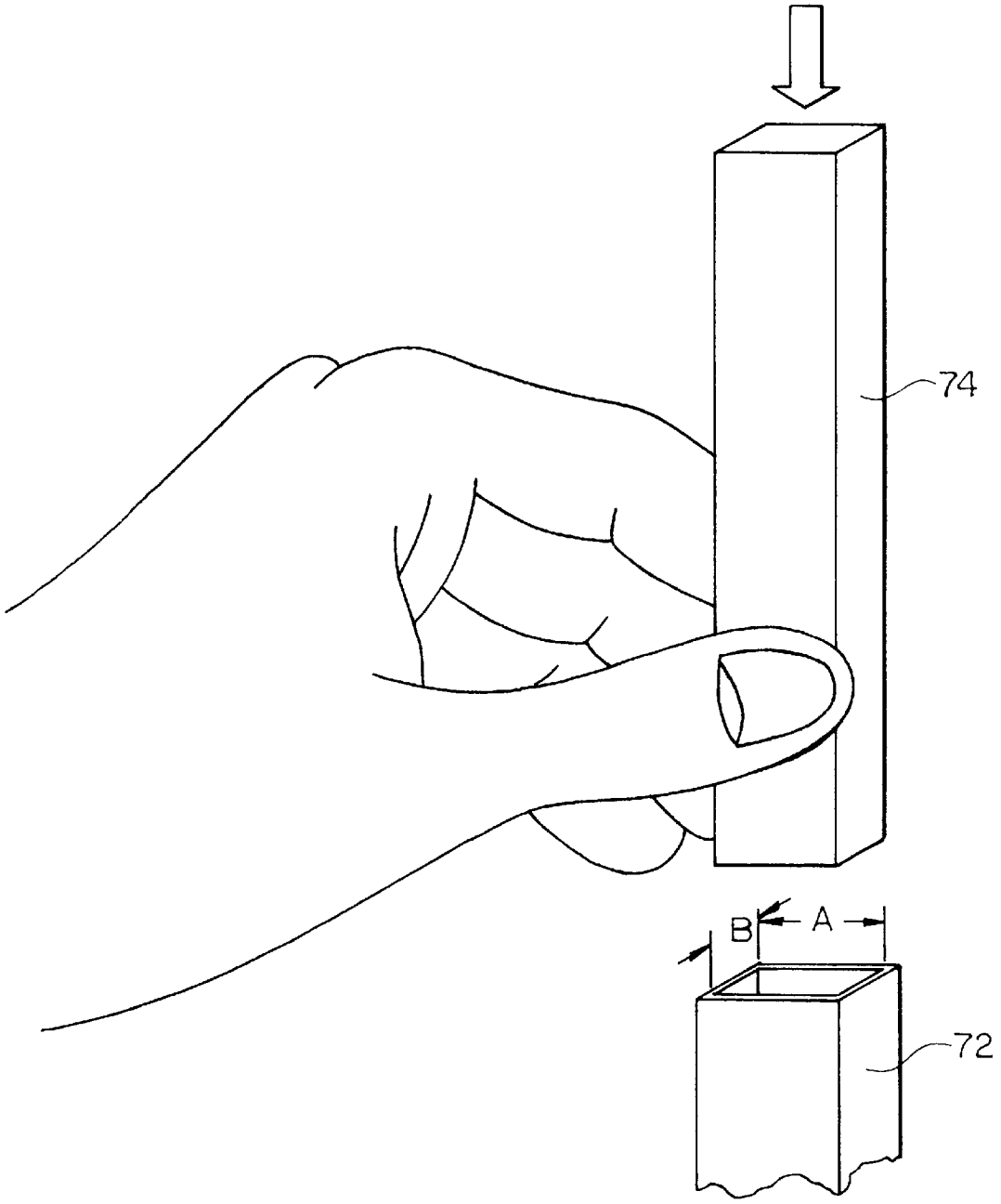
FIG. 2 PRIOR ART
FIG. 2 is an elevational perspective view showing a package being inserted into the merchandising rack of FIG. 1.
Figure 3:
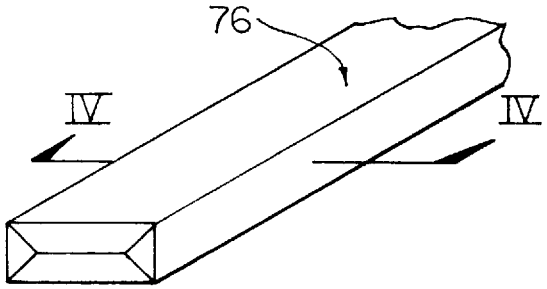
FIG. 3 PRIOR ART
FIG. 3 is a fragmentary perspective view showing a conventional cardboard package as employed with the merchandising rack of FIG. 1.

Referring now to the drawing, and in particular FIGS. 1 and 2, an upright merchandising rack 70 is shown which is provided with a plurality of rectangular product enclosures 72 which are of fixed cross-sectional area and, as set forth above, are generally of a standard size for displaying a packaged article. A plurality of packages 74 are generally disposed upright in each of the enclosures 72 for examination or viewing by the customer with easy access for removal. While the package 74 may take a number of forms which will be described below, in its simplest form as an elongated structure having a substantially rectangular cross-section, it is evident that the width and depth dimension of the package cannot exceed the dimension A and B which forms the cross-section of the enclosure 72. Therefore, the problem arises in packaging a device of the greatest width and depth dimension which can be retained within the enclosure 72, and the package, itself, must approach the dimension A and B in its width and depth dimension to achieve this result.

Figure 4:
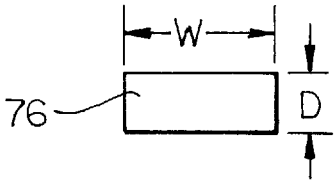
FIG. 4 PRIOR ART
FIG. 4 is a cross-sectional elevational view taken along the line IV—IV of FIG. 3 showing details of that structure.

Referring to FIGS. 3 through 6, there is shown a cardboard-type package 76 and a blister-card-type display package 78, both of which have been employed in the prior art. The cardboard package 76 has proved to be adequate in containing articles like toothbrushes and positioning them in various types of displays including a merchandising rack similar to rack 70. However, cardboard displays suffer from detriments in that they do not provide the consumer with a view of the article prior to purchase, and they are prone to crushing. Accordingly, extensive graphics are required on the cardboard packaging or expensive windowing is required. As shown in FIG. 4, these articles may be constructed of a width and depth dimension W and D which will take advantage of the entire cross-sectional area of the enclosure 72, however, the aforementioned drawbacks make this form of package quite often undesirable.

Figure 5:
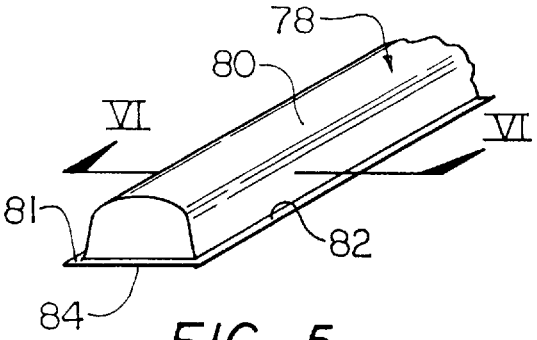
FIG. 5 PRIOR ART
FIG. 5 is a fragmentary perspective view showing a conventional blister package for use in the merchandising rack of FIG. 1.
Figure 6:
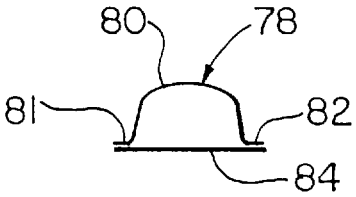
FIG. 6 PRIOR ART
FIG. 6 is a cross-sectional elevational view taken along the lines VI—VI of FIG. 5, showing details of that structure.

Referring to FIGS. 5 and 6, the manufacturers have generally shifted over to a blister-card-type display package or simply "blister package" 78 which provides a clear, molded plastic enclosure allowing the consumer to view the product prior to purchase. The blister package 78 generally is manufactured of a plastic material which forms a dome-like structure 80 having a pair of outwardly-extending flanges 81 and 82 which extend outwardly beyond the cavity formed by the dome-like structure 80. A closure member 84, which is typically coated cardboard or plastic, when sealed to the flanges 81 and 82 serves to complete the package structure. As is evident in viewing FIG. 6, such a structure, as is typical with the blister-card package 78, is limited in its accessibility to the enclosure 72 by the width dimension of the closure member 84, which must be less than the maximum dimension of the cross-section of an enclosure 72. As is evident from FIG. 6, the cavity in which the article to be displayed is enclosed within the dome-like structure 80, by virtue of its construction, provides a width dimension which is substantially less than the width dimension of the closure member 84.

Figure 7:
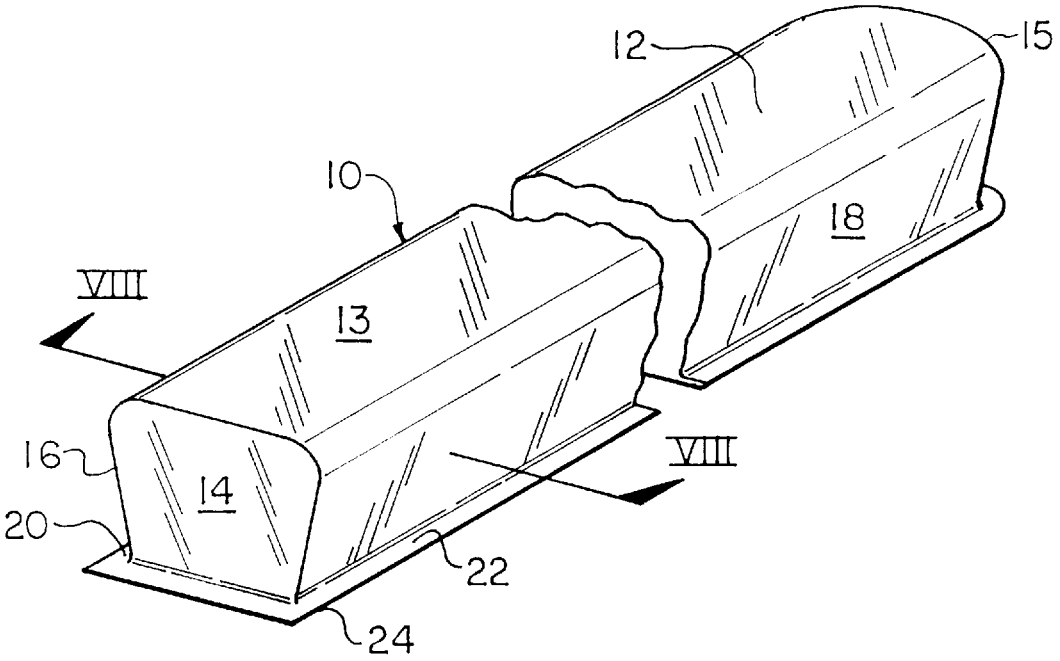
FIG. 7 is a fragmentary elevational view similar to FIGS. 3 and 5 showing a blister-card package constructed in accordance to the teachings of the present invention.
Figure 8:
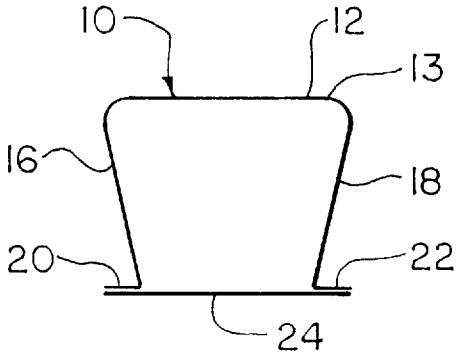
FIG. 8 is a cross-sectional elevational view taken along the line VIII—VIII of FIG. 7 showing the blister-card package of FIG. 7 in detail.

Referring now to FIGS. 7 and 8, the present invention provides a blister-card package 10 which is intended to reduce the limitations of the size of the article that can be displayed in a blister package of the type shown in FIGS. 5 and 6. As shown in FIGS. 7 and 8, the blister package 10 comprises a molded plastic envelope 12 formed of a plastic sheet which in this embodiment contains a substantially flat top or upper wall 13, a pair of end walls 14 and 15, and a pair of opposed side walls 16 and 18. The walls 13, 14, 15, 16 and 18 form a cavity in which the item to be displayed is enclosed.

In order to enclose the cavity provided in the envelope 12, an outwardly-extending flange means is attached to the lower edge of each of the walls 14, 15, 16 and 18, completely circling opening in the envelope 12. Each of the side walls 16 and 18 has a flange portion 20 and 22 respectively disposed at the lower edge thereof for fastening purposes, as will be described below.

In order to enclose the cavity formed in the plastic envelope 12, a substantially elongate planar member in the form of closure member 24 is provided. The assembly is completed by affixing the closure member 24 to the flange means disposed at the bottom edges of the walls 14, 15, 16 and 18 with suitable sealing methods, which are well known in the art.

Figure 11:
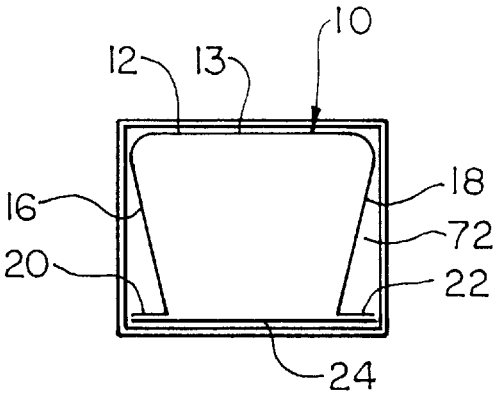
FIG. 11 is a cross-sectional view taken through a product enclosure of the merchandising rack of FIG. 1, showing the blister-card of FIG. 7 received within the product enclosure for display purposes.

As is evident in FIG. 8, each of the side walls 16 and 18 is oriented downwardly and inwardly of the internal cavity of the envelope 12 such that its lower edge is within the outer edge of the closure member 24. Thus, by constructing the side walls 16 and 18 such that the uppermost portion extends a distance equal to or greater than the distance between the opposite side edges of the closure member 24, the envelope 12 provides a cavity which is of greater volume than that of the prior art, while allowing for adequate area at the flanges 20 and 22 for attachment to the closure member 24. It will, therefore, be evident that when the blister-card package 10 is accommodated by an enclosure 72 in an upright merchandising rack 70 as depicted in FIG. 11, a maximum-size object may be enclosed within the blister package while maintaining dimensions which approach of the inner dimensions of the enclosure 72.

Figure 9:
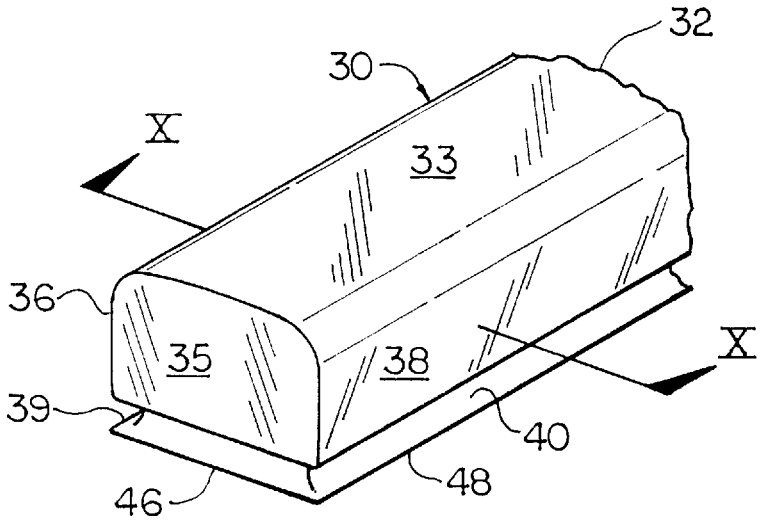
FIG. 9 is a fragmentary elevational view similar to FIG. 7 showing an alternate embodiment to that of the blister-card package of FIG. 7.
Figure 10:
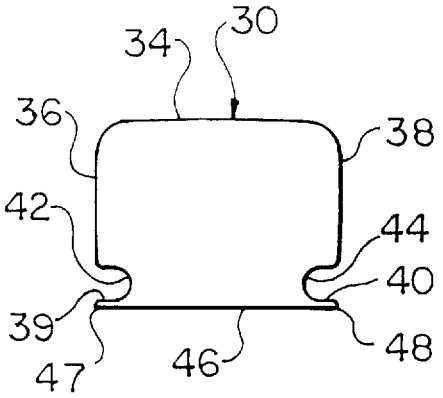
FIG. 10 is a cross-sectional elevational view taken along the line X—X of FIG. 9 showing details of the structure of FIG. 9.

Referring now to FIGS. 9 and 10, an alternate embodiment of the invention is shown as a blister package 30 similar to that shown in FIG. 10, comprising a plastic envelope 32 having a top surface 33, an end surface 34 (the opposite end surface being similar and not shown) and a pair of side walls 36 and 38 one opposite the other. As with the blister package 10, a cavity is formed within the envelope 32, the opening in the envelope having a continuous flange means extending around the lower edge of the cavity walls which include outwardly-extending edge portions 39 and 40.

However, in the embodiment under discussion, the side walls 36 and 38 extend downwardly from the upper wall 34 in substantially parallel relation one with the other, and the lower edges of each are connected to the flange portions 39 and 40 by elongate portions 42 and 44. The elongate portions 42 and 44 are of arcuate form extending into the cavity and sure to connect the bottom edges of a respective side wall 36 or 38 to the flange portions 39 and 40. As in the blister package 10, a closure member 46 of planar elongate structure having side edges 47 and 48 approaching the width of an enclosure 72 is attached to the outwardly-extending flange portions 39 and 40. The pair of opposed side walls 36 and 38 are spaced one from the other a distance equal to or greater than the distance between the opposite side edges 47 and 48 of the planar member 46 for at least a portion of the length of the elongated plastic envelope 32. As with the blister package 10, the blister package 30 provides a structure formed such that, when introduced into an enclosure 72, the maximum cross-section determining the volume within the enclosure is occupied by the cavity within the envelope 32, therefore allowing objects of greater dimension to be enclosed within the blister package 30, than in those of the prior art.

Figure 12:
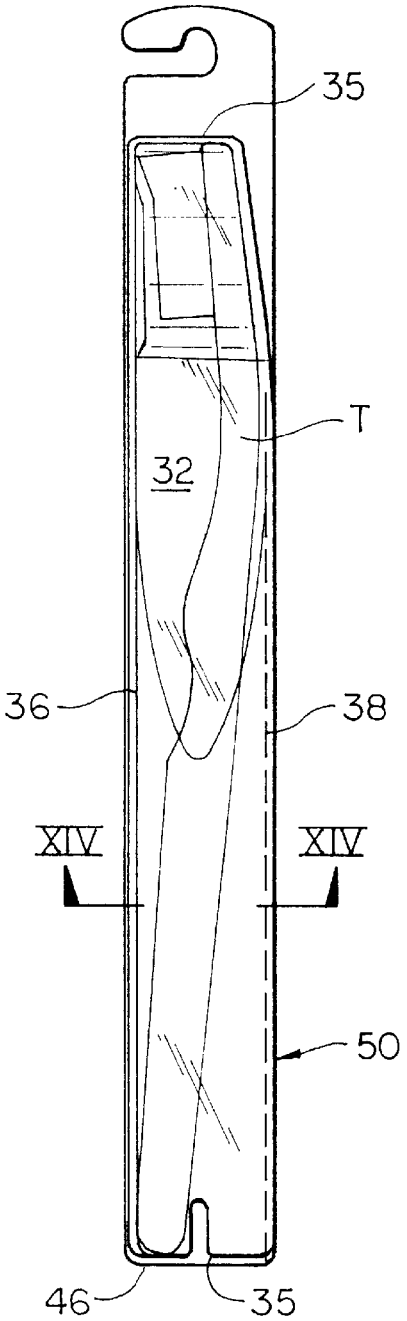
FIG. 12 is a front elevational view showing the blister-card package of FIG. 8 having a toothbrush displayed therein and including an optional hanging member for use in hanging displays.
Figure 13:
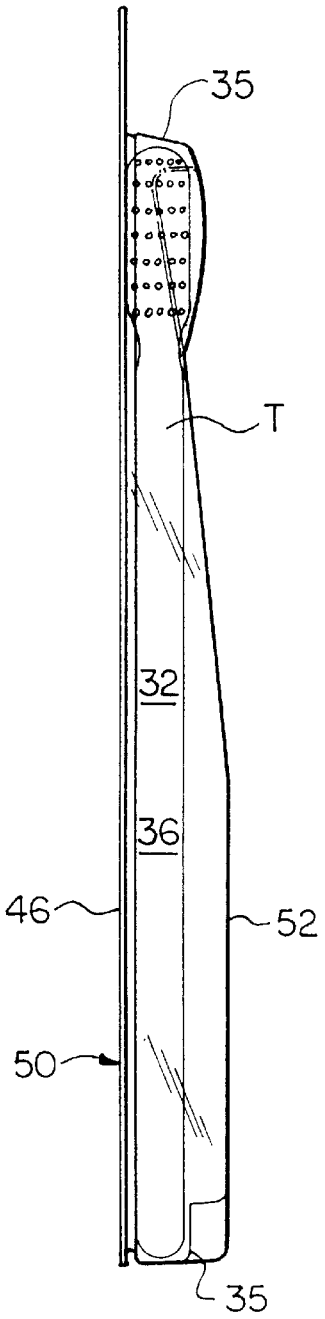
FIG. 13 is a left side elevational view of the blister-card package of FIG. 12 showing details of the structure.
Figure 14:
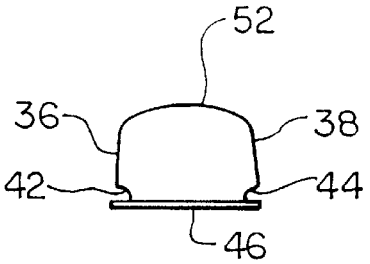
FIG. 14 is a cross-sectional view taken along the lines XIV—XIV of FIG. 13 showing the structure of the blister-card package with the toothbrush removed.

Referring now to FIGS. 12 through 14, a blister package 50 is shown in its entirety having a toothbrush T contained therein. As shown in FIG. 14, at the larger section of the blister package 50 the structure is identical to that of the package 30, but with an upper wall 52 which is domed-shaped opening into the envelope cavity formed by the walls 36, 38 and end walls 35. However, as is evident from FIGS. 12 and 13, the envelope formed by the walls 36, 38, 35 and 52 need only be constructed of maximum width and depth at the widest portion of the toothbrush T (which is the handle width), and the remainder of the plastic structure forming the envelope 32 may be reduced to the form of the article being displayed if desired. Additionally, the ends of the blister package may take any configuration including that having an opening formed in the closure member 46 for use in displaying the blister package 50 on a rod, or other hanger device.

While it is apparent that changes and modifications can be made within the spirit and scope of the present invention, it is my intention, however, only to be limited by the appended claims.

As my invention I claim:

1. A blister package for use in an upright merchandising rack comprising:

an elongate molded plastic envelope having a pair of opposed side walls, a pair of end walls and an upper wall to form a cavity therebetween, said envelope having an opening opposite said upper wall;

a substantially elongate planar member covering said opening opposite said upper wall, said planar member having a pair of opposite side edges each disposed adjacent a respective envelope side wall, and a pair of end edges;

flange means disposed on said pair of opposed side walls for attachment of said pair of opposed side walls to said elongate planar member, said flange means extending outwardly from said cavity and substantially parallel with said planar member; and said pair of opposite side walls being spaced one from the other a distance equal to or greater than the distance between said opposite side edges of said planar member for at least a portion of the length of said elongate plastic envelope.

2. A blister package as set forth in claim 1 wherein each of said side walls is oriented downwardly and inwardly of said cavity, having its bottom edge attached to the inner edge of said flange means.

3. A blister package as set forth in claim 1 wherein said opposite side walls are spaced one from the other a distance equal to or greater than the distance between said planar member side edges over the entire length of each said side wall.

4. A blister package as set forth in claim 1 wherein said planar member is formed of paperboard material.

5. A blister package as set forth in claim 1 wherein said upper wall forms an elongate arcuate surface opening into said cavity.

6. A blister package as set forth in claim 1 wherein said upper wall forms an elongate surface substantially parallel with said elongate planar surface.

7. A blister package as set forth in claim 2 wherein said opposite side walls are spaced one from the other a distance equal to or greater than the distance between said planar member side edges over the entire length of each said side wall.

8. A blister package as set forth in claim 7 wherein said planar member is formed of paperboard material.

9. A blister package as set forth in claim 8 wherein said upper wall forms an elongate surface opening into said cavity substantially parallel with said elongate planar surface.

10. A blister package as set forth in claim 7 wherein said upper wall forms an elongate arcuate surface opening into said cavity.

11. A blister package as set forth in claim 1 wherein each said side walls is provided with an elongate portion at its bottom edge said elongate portion being of arcuate form extending into said cavity and connecting said bottom edge of a respective side wall to said flange means.

12. A blister package as set forth in claim 11 wherein said opposite side walls are spaced one from the other a distance equal to or greater than the distance between said planar member side edges over the entire length of each said side wall.

13. A blister package as set forth in claim 12 wherein said upper wall forms an elongate arcuate surface opening into said cavity.

14. A blister package as set forth in claim 12 wherein said upper wall forms an elongate surface substantially parallel with said elongate planar surface.

15. In combination, an upright merchandising rack comprising a plurality of display enclosures, each enclosure of a fixed rectangular cross-section having a width and height dimension;

a blister package disposed in said enclosure comprising an elongate molded plastic envelope having a pair of opposed side walls, a pair of end walls and an upper wall to form a cavity therebetween, said envelope having an opening opposite said upper wall; and a substantially elongate planar member covering said opening opposite said upper wall, said planar member having a pair of opposite side walls each disposed adjacent a respective envelope side wall and a pair of end edges;

said pair of opposite side walls being spaced one from the other a distance equal to or greater than the distance between said opposed side edges of said planar member for at least a portion of the length of said plastic envelope and said distance between said side walls being slightly less than and approaching said width dimension of said enclosure.

* * * * *

US005769228B1

REEXAMINATION CERTIFICATE (4212th)

United States Patent [19] [11] B1 5,769,228

Wroblewski [45] Certificate Issued Nov. 21, 2000

[54] DISPLAY PACKAGE

[75] Inventor: Gerald Wroblewski, Half Moon Bay, Calif.

[73] Assignee: Gillette Canada Inc., Kirkland, Canada

Reexamination Request:
No. 90/005,246, Feb. 4, 1999

Reexamination Certificate for:

| | |
|---|---|
| Patent No.: | **5,769,228** |
| Issued: | **Jun. 23, 1998** |
| Appl. No.: | **08/772,140** |
| Filed: | **Dec. 20, 1996** |

[51] Int. Cl.[7] ..... B65D 75/00
[52] U.S. Cl. ..... 206/461; 206/775
[58] Field of Search ..... 206/461, 462, 206/463, 464, 465, 467, 468, 469, 470, 471, 475

[56] References Cited

FOREIGN PATENT DOCUMENTS

| | | |
|---|---|---|
| 0638269A1 | 2/1995 | European Pat. Off. . |
| 1193865 | 5/1965 | Germany . |
| 1264319 | 3/1968 | Germany . |

*Primary Examiner*—Jacob K. Ackun, Jr.

[57] ABSTRACT

A blister package is provided for display in a merchandising rack having a plurality of display enclosures of fixed cross-sectional dimension. The blister package provides a product-containing envelope of plastic material forming a cavity capable of displaying large size articles approaching the maximum dimensions of a display enclosure.

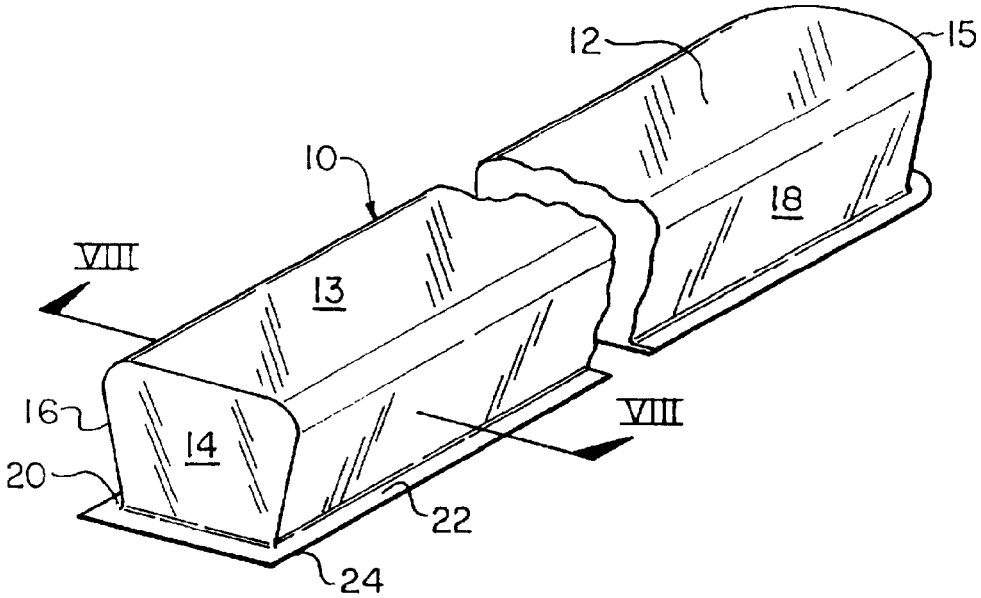

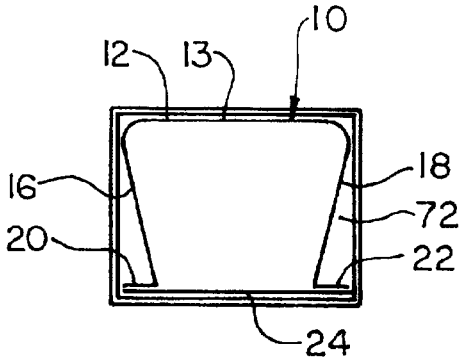

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 15 is confirmed.

Claims 1–14 are cancelled.

* * * * *